US008360224B2

(12) United States Patent
Park et al.

(10) Patent No.: US 8,360,224 B2
(45) Date of Patent: Jan. 29, 2013

(54) AUTOMATIC TELLER MACHINE

(75) Inventors: Chang Ho Park, Seoul (KR); Yun Seok Jeong, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 85 days.

(21) Appl. No.: 13/057,476

(22) PCT Filed: Aug. 11, 2009

(86) PCT No.: PCT/KR2009/004454

§ 371 (c)(1),
(2), (4) Date: Feb. 3, 2011

(87) PCT Pub. No.: WO2010/018962

PCT Pub. Date: Feb. 18, 2010

(65) Prior Publication Data

US 2011/0132718 A1 Jun. 9, 2011

(30) Foreign Application Priority Data

Aug. 11, 2008 (KR) ..... 10-2008-0078609
Aug. 12, 2008 (KR) ..... 10-2008-0079131

(51) Int. Cl.
*G07F 7/04* (2006.01)

(52) U.S. Cl. ..... 194/206; 902/13

(58) Field of Classification Search ..... 194/206, 194/207; 209/534; 902/13; 312/249, 249.4, 312/402, 249.11, 330.1, 334.1, 334.2–334.5, 312/334.37, 334.46, 334.47; 271/145; 361/679, 361/679.01, 679.02, 679.4, 679.41, 679.43, 361/679.58, 724–733, 747, 796–798, 803; 232/4 D See application file for complete search history.

(56) References Cited

U.S. PATENT DOCUMENTS
(Continued)

FOREIGN PATENT DOCUMENTS

JP 2005-219889 8/2005
JP 2006-176330 7/2006

(Continued)

OTHER PUBLICATIONS

International Search Report mailed Mar. 29, 2010.

(Continued)

*Primary Examiner* — Jeffrey Shapiro
(74) *Attorney, Agent, or Firm* — Hershkovitz & Associates, LLC; Abraham Hershkovitz

(57) ABSTRACT

Provided is an automatic teller machine (ATM), including: a body to process depositing or withdrawing of a paper medium; a cassette being slidably attached to and detached from the body, and comprising a cassette coupler formed on one side of the cassette to receive a power from the body, and to internally receive the paper medium; a receiving unit being formed within the body to install the cassette, and comprising a body coupler being combined with the cassette coupler when installing the cassette to thereby transfer the power from the body to the cassette; and a combining unit being formed on each of the body coupler and the cassette coupler so that a rotation center line of the body coupler and a rotation center line of the cassette coupler are matched on the same axial line to thereby combine the body coupler and the cassette coupler. Since it is possible to use, for an operation of the cassette, the power transferred from the body of the ATM, a separate driving unit for driving the cassette may be omitted.

9 Claims, 15 Drawing Sheets

U.S. PATENT DOCUMENTS

| | | | | |
|---|---|---|---|---|
| 7,379,701 | B2 | 5/2008 | Yonemoto | |
| 2006/0140695 | A1 | 6/2006 | Yonemoto | |
| 2008/0287015 | A1 * | 11/2008 | Cha et al. | 439/893 |

FOREIGN PATENT DOCUMENTS

| | | |
|---|---|---|
| KR | 10-0183760 | 12/1998 |
| KR | 10-2006-0117403 | 11/2006 |

OTHER PUBLICATIONS

Abstract of KR 10-0183760.
Abstract of KR 1020060117403.
Abstract of JP 2005-219889.
Abstract of JP 2006-176330.

* cited by examiner

AUTOMATIC TELLER MACHINE

TECHNICAL FIELD

The present invention relates to an automatic teller machine (ATM), and more particularly, to an ATM that may receive a power of a body of an ATM and use the power for an operation of a cassette, and may also more accurately mound the body of the ATM and the cassette.

BACKGROUND ART

In general, an automatic teller machine (ATM) may provide customers with convenient financial services in a bank, other financial institutions, and the like, and thus, has been employed in a convenient store, a public location, and the like in addition to the financial institution. The ATM may provide a variety of financial services such as depositing or withdrawing of a paper medium such as paper money, a check, and the like, balance verification, an account transfer, and the like. A variety of modules such as a depositing module, a withdrawing module, a card reader, a bankbook arrangement module, and the like, may be independently mounted to the ATM. The modules may be electrically connected to a main controller, and be appropriately controlled by the main controller.

The ATM may include a cassette to supply a paper medium to the withdrawing module, or to receive the paper medium from the depositing module and thereby load the paper medium. Specifically, the withdrawing module may receive the paper medium from the cassette and withdraw the paper medium to an outside of the ATM. The depositing module may receive the paper medium from the outside of the ATM and receive the paper medium within the cassette. The cassette may be attachable to and be detachable from the body of the ATM. An operation of supplying or retrieving the paper medium with respect to the ATM may be more stably and conveniently performed.

To be supplied with a power used for entrance and exit of a paper medium, a conventional cassette may include a separate driving unit such as a motor. Accordingly, an operation of the conventional cassette may be controllable independently from the body by including the separate driving unit. However, when the driving unit is separately provided within the cassette, a load and a size of the cassette may increase and a manufacturing cost of the cassette may also increase. In addition, the cassette may include a separate control program to control the driving unit. The body and the cassette may use a separate power supply structure to supply a power from the body to the cassette.

In addition, the cassette may be disposed within the body to be electrically connected to the body and thereby drive a transfer unit provided in the cassette. When the cassette and the body are installed, the cassette may need to be installed at an exact position within the body.

When the cassette is not installed at the exact position within the body, a power provided from the power or the cassette may not be properly transferred and thus, an error may occur when paper money is deposited or withdrawn.

Also, when the body of the ATM and the cassette are not exactly engaged with each other, a paper medium such as paper money transferred via a transfer path of the ATM may not be exactly guided into an inside of the cassette and thus, a jam may occur in an entrance side of the cassette.

DISCLOSURE OF INVENTION

Technical Goals

An aspect of the present invention provides an automatic teller machine (ATM) that may receive a power of a body of an ATM and use the power for an operation of a cassette.

Another aspect of the present invention also provides an ATM that may have a very simple power transfer structure of a body and a cassette, and also enables couplers for a power transfer to be smoothly combined with each other.

Another aspect of the present invention also provides an ATM that may more accurately mount a cassette to a body of an ATM and thereby enables a proper power transfer.

Another aspect of the present invention also provides an ATM that may guide a position of a cassette to be installed at an exact position within the body when the cassette is received within the body.

Another aspect of the present invention also provides an ATM that may reduce a transfer error of a paper medium transferred between a body of an ATM and a cassette.

Technical Solutions

According to an aspect of the present invention, there is provided an automatic teller machine (ATM), including: a body to process depositing or withdrawing of a paper medium; a cassette being slidably attached to and detached from the body, and comprising a cassette coupler formed on one side of the cassette to receive a power from the body, and to internally receive the paper medium; a receiving unit being formed within the body to install the cassette, and comprising a body coupler being combined with the cassette coupler when installing the cassette to thereby transfer the power from the body to the cassette; and a combining unit being formed on each of the body coupler and the cassette coupler so that a rotation center line of the body coupler and a rotation center line of the cassette coupler are matched on the same axial line to thereby combine the body coupler and the cassette coupler. Since the power of the body is transferred to the cassette by means of a mechanical combination between the body coupler and the cassette coupler, the power of the body may be commonly used by the cassette and the cassette may omit a separate driving unit.

A combination grooving unit may be formed in either the combining unit formed in the body coupler or the combining unit formed in the cassette coupler, from a rotation center towards a radius direction. A combining protrusion in a shape corresponding to the combination grooving unit may be formed in the other combining unit to be inserted into the combination grooving unit. A plurality of combination grooving units and a plurality of combination protrusions may be formed in a radiation form at the same angle based on the rotation center line of the body coupler and the cassette coupler. Accordingly, the body coupler and the cassette coupler may be combined with each other in a simple structure where the combining protrusion is inserted into the combination grooving unit.

In the combination grooving unit, a second sidewall having a normal of a direction opposite to a rotation direction of the cassette coupler and the body coupler may be formed to be higher than a first sidewall having a normal of the same direction as the rotation direction of the cassette coupler and the body coupler. The combining unit formed with the combination grooving unit may include an inclination guide unit being formed between the first sidewall and the second sidewall so that a height linearly decreases with going from the second sidewall towards the first sidewall along the rotation direction of the cassette coupler and the body coupler. Accordingly, even though the combining protrusion and the combination grooving unit are not combined with each other when the body coupler and the cassette coupler are combined with each other, the combining protrusion may be moved along the inclination guide unit to thereby be quickly and simply combined with the combination grooving unit when the body coupler is rotated.

The cassette may include: a first guide unit being formed on one side of the cassette along a direction of the cassette attached to and detached from the body to thereby guide a sliding motion of the cassette when the cassette is attached to or detached from the body; and a second guide unit being formed on one side of the cassette to maintain an engaged state when the cassette is mounted to the body.

The cassette may further include a third guide unit being formed with a guide hole being inserted with a guide pin protruded from the receiving unit towards a detachment direction of the cassette to thereby guide the cassette coupler to exactly be engaged with the body.

Through the above configuration, the cassette may be more exactly received within the body of the ATM. Due to the cassette received at the exact position, the power may be properly transferred from the body of the ATM to the cassette.

The second guide unit may include a plurality of receiving grooves being formed along a slide direction of the cassette, and the receiving unit may include an elastic member to be engaged with the receiving grooves when the cassette is received within the receiving unit.

The elastic member may be provided as a curved pan spring. Curved portions of the pan spring may be positioned in the receiving grooves in a state where the cassette is engaged with the body, to thereby enable the cassette to be fixed to the body.

The receiving grooves may be formed in an area disposed in a diagonal direction among four areas divided by a vertical line and a horizontal line crossing a center of the second guide unit, to thereby uniformly support and fix one side of the cassette with balancing left and right of the cassette.

The cassette may further include a fourth guide unit being bound with a blocking protrusion of a pan spring scheme provided on a bottom surface of the receiving unit. With the combining protrusion being bound with the fourth guide unit, the body and the cassette may be further firmly engaged with each other.

The first guide unit and the second guide unit may be formed on each of both sides of the cassette, and the receiving grooves may be formed to be positioned in opposition positions with respect to the second guide unit disposed on each of both sides of the cassette. Accordingly, with balancing both sides of the cassette, the cassette may be attached to and detached from the body of the ATM.

Effect of the Invention

In an automatic teller machine (ATM) according to embodiments of the present invention, a cassette may receive a power of a body of the ATM and commonly use the power of the body and thus, it is possible to omit a separate driving unit for driving the cassette.

Also, according to embodiments of the present invention, since a driving unit for driving a cassette is omitted, the cassette may be configured in a very simple structure and a load and a size of the cassette may decrease. A manufacturing cost of the cassette may also decrease.

Also, according to embodiments of the present invention, since a body coupler and a cassette coupler are combined with each other to thereby transfer the power of the body to the cassette, the power transfer structure of the body and the cassette may be simplified.

Also, according to embodiments of the present invention, a combining protrusion may be formed in either a combining unit of a body coupler or a combining unit of a cassette coupler. A combination grooving unit inserted with the combining protrusion may be formed in the other combining unit. An inclination guide unit to guide the combining protrusion to the combination grooving unit may be formed in a portion where the combination grooving unit of the combining unit is not formed. Accordingly, the combining protrusion may be quickly and simply inserted into the combination grooving unit whereby a combination of the body coupler and the cassette coupler may be smoothly performed.

Also, according to embodiments of the present invention, since a body of an ATM and a cassette are firmly installed, a power may be effectively transferred from the body to the cassette.

Also, according to embodiments of the present invention, a cassette may be guided to be installed at an exact position within a body of an ATM, thereby facilitating receiving of the cassette.

Also, according to embodiments of the present invention, it is possible to reduce a transfer error of a paper medium between a body of an ATM and a cassette.

BEST MODE FOR CARRYING OUT THE INVENTION

Figure 1:
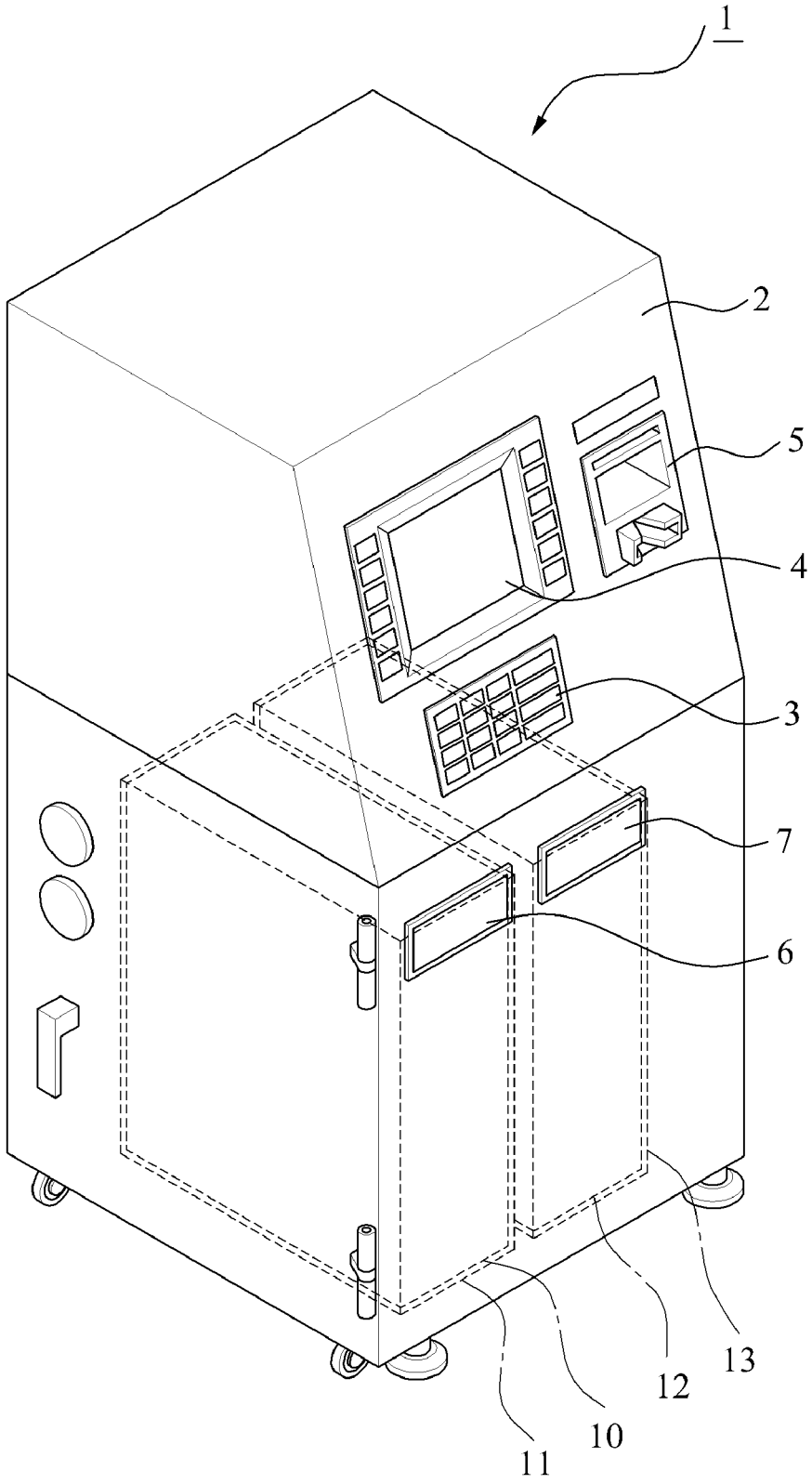
FIG. 1 is a perspective view illustrating an automatic teller machine (ATM) according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, embodiments of the present invention will be described with reference to the accompanying drawings. FIG. 1 is a perspective view illustrating an automatic teller machine (ATM) 1 according to an embodiment of the present invention.

Referring to FIG. 1, the ATM 1 may include a body 2 to process depositing or withdrawing of a paper medium, and cassettes 10 and 12 being attached to and detached from the body 2 to internally receive the paper medium.

The body 2 may include a manipulation unit 3 to input various types of passwords, numbers, and the like for use of the ATM, a display unit 4 to display an operation of the ATM 1 and an input value of the manipulation unit 3, a recognition unit 5 to recognize a card or a bankbook, a depositing unit 6 to deposit the paper medium, and a withdrawing unit 7 to withdraw the paper medium. A control unit for controlling operations of the manipulation unit 3, the display unit 4, the recognition unit 5, the depositing unit 6, and the withdrawing unit 7 may be disposed within the body 2. A power source, for example, a motor, for a mechanical operation of the recognition unit 5, the depositing unit 6, and the withdrawing unit 7 may be disposed. Receiving units 11 and 13 may be formed within the body 2 to enable the cassettes 10 and 12 to be readily attachable and detachable.

The cassettes 10 and 12 may include a depositing cassette (also, referred to as the depositing cassette 10) being connected to the depositing unit 6 to receive the paper medium, and a withdrawing cassette (also, referred to as the withdrawing cassette 12) being connected to the withdrawing unit 7 to supply the paper medium. The depositing cassette 10 and the withdrawing cassette 12 may be mounted to the receiving units 11 and 13 to correspond to and thereby be connected to the depositing unit 6 and the withdrawing unit 7, respectively. However, the present invention is not limited to the depositing cassette 10 and thus, may be applicable to the withdrawing cassette 12 and a depositing/withdrawing cassette.

Figure 2:
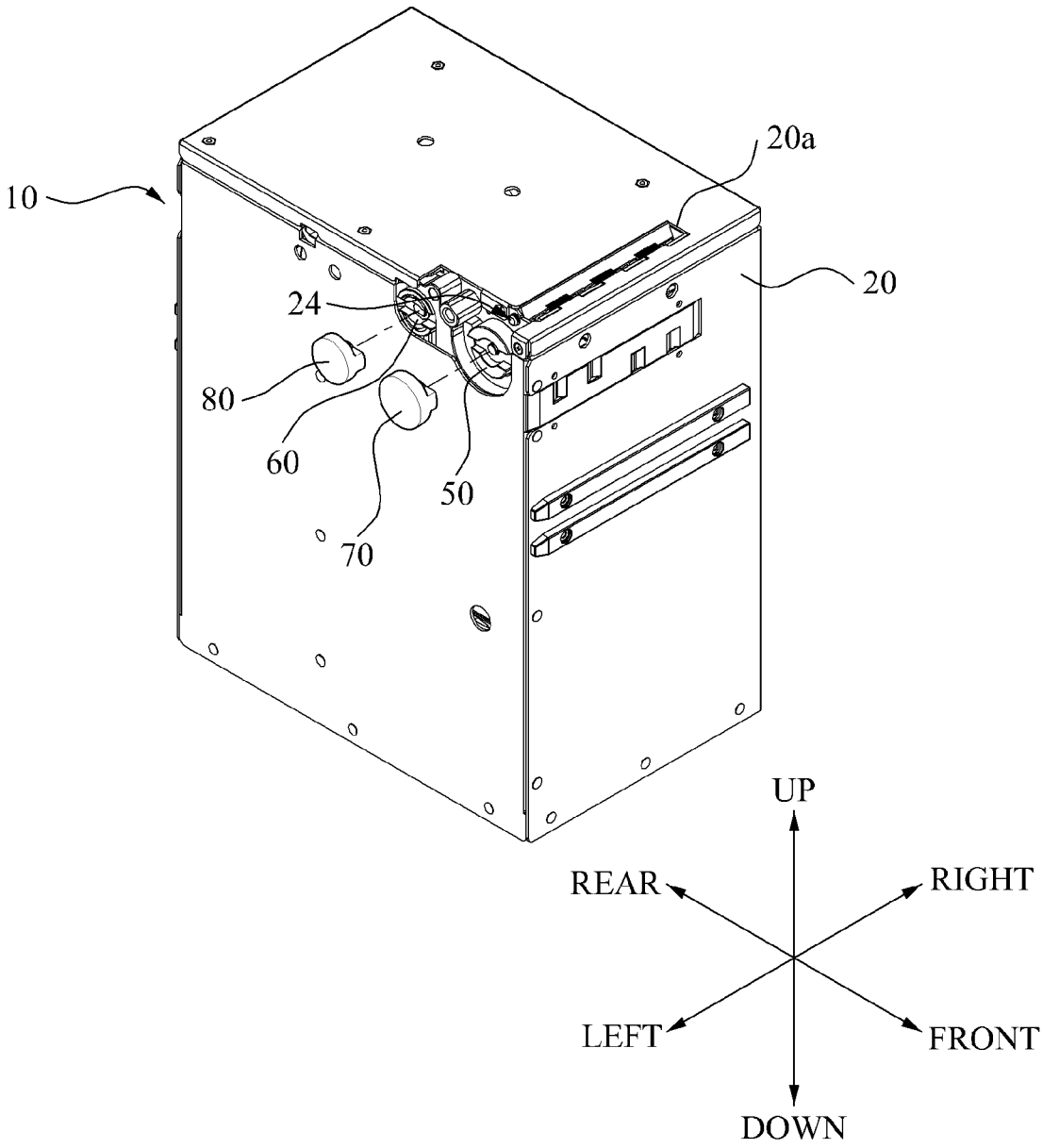
FIG. 2 is a perspective view illustrating a cassette of the ATM of FIG. 1.
Figure 3:
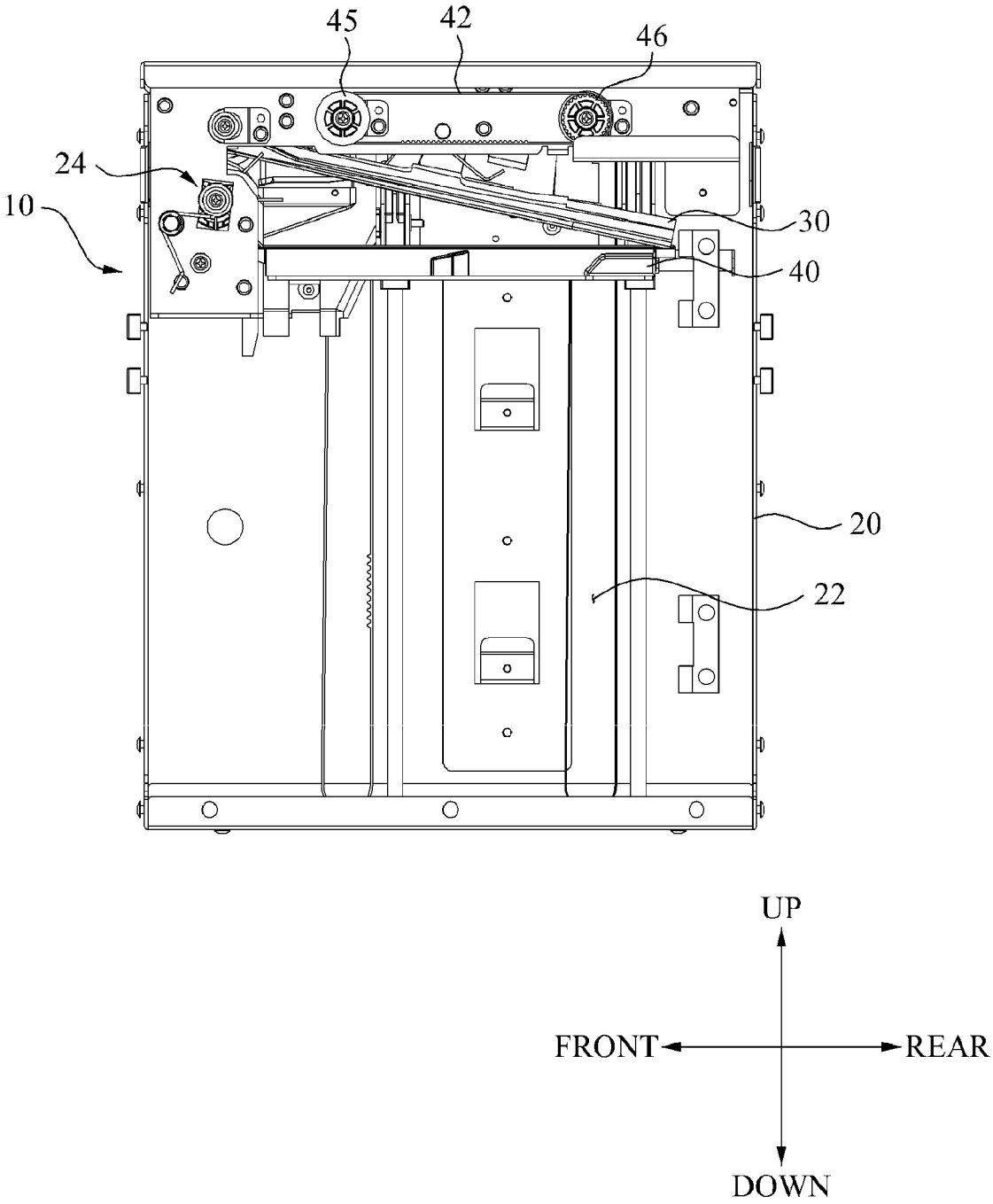
FIG. 3 is a right side view illustrating an inside of the cassette of FIG. 2.
Figure 4:
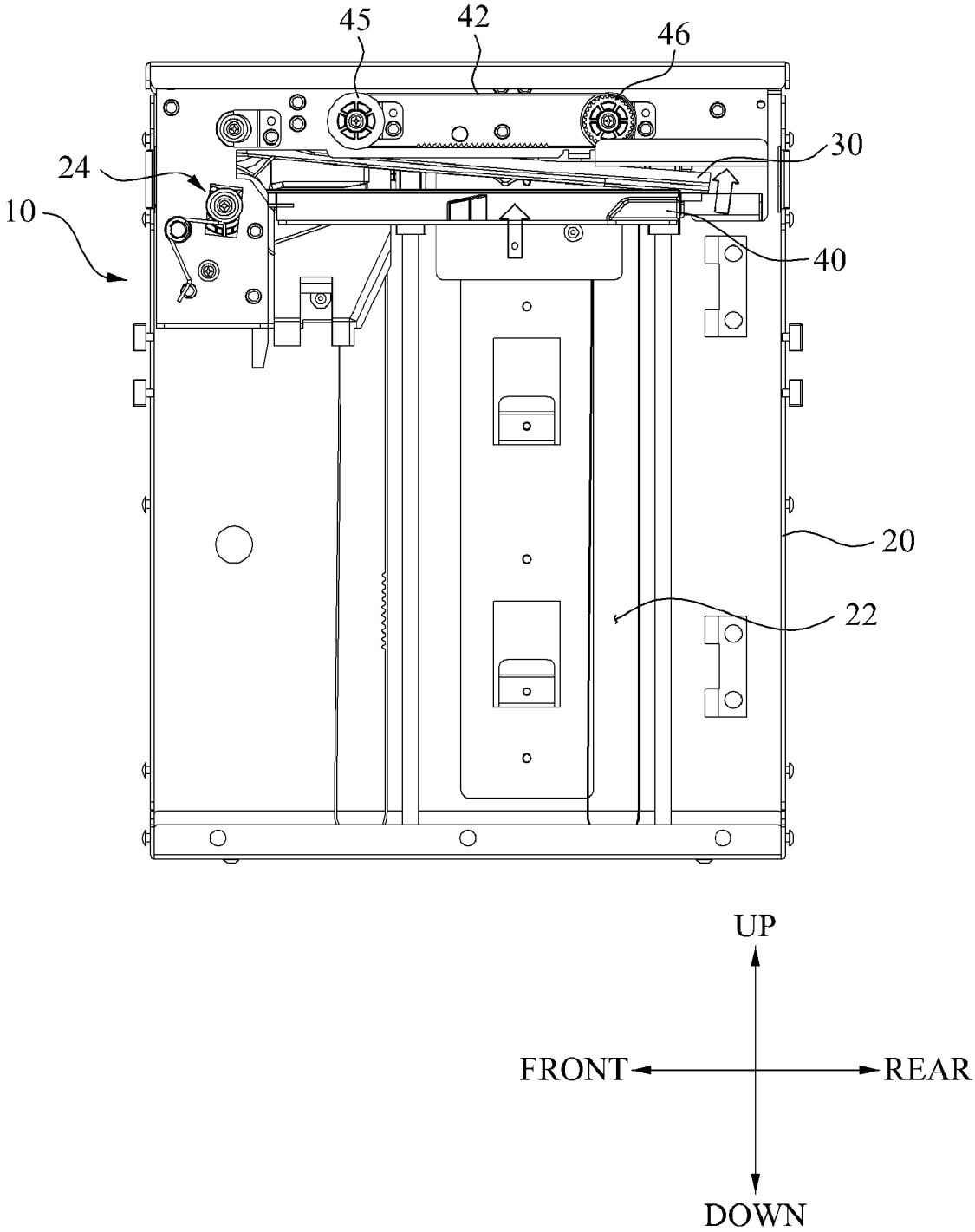
FIG. 4 is a right side view illustrating an operational state of a first stack plate and a second stack plate of FIG. 3.
Figure 5:
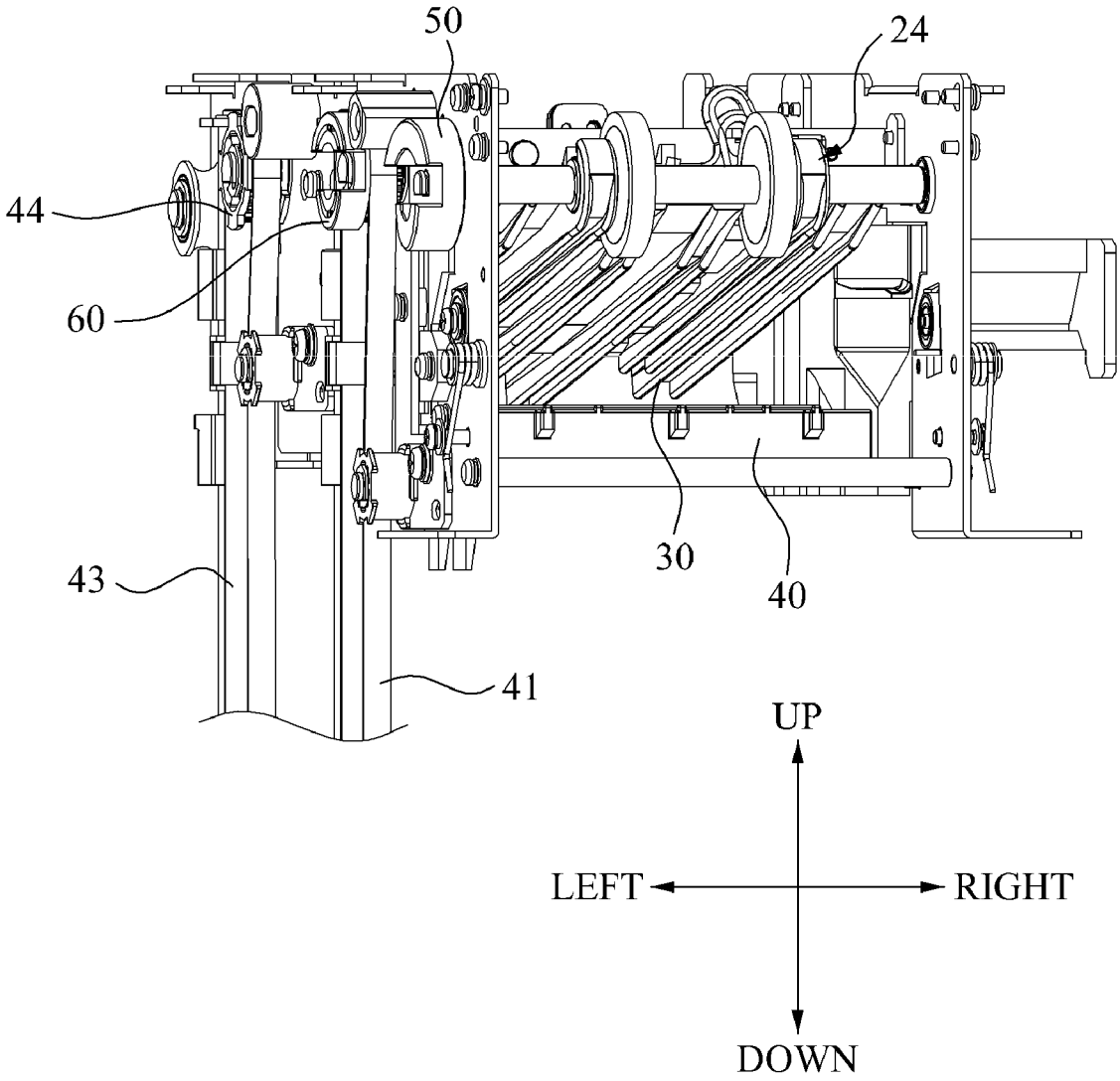
FIG. 5 is a perspective view illustrating major components of the cassette of FIG. 2.

FIG. 2 is a perspective view illustrating the cassette 10 of the ATM 1 of FIG. 1, FIG. 3 is a right side view illustrating an inside of the cassette 10 of FIG. 2, FIG. 4 is a right side view illustrating an operational state of a first stack plate 30 and a second stack plate 40 of FIG. 3, and FIG. 5 is a perspective view illustrating major components of the cassette 10 of FIG. 2.

Referring to FIG. 2 through FIG. 4, the cassette 10 may include a case 20 including a medium receiving unit 22 to receive the paper medium, and an entrance and exit portion 24 to enable entering and exiting of the paper medium in an upper portion of the case 20, the first stack plate 30 being disposed within the paper medium receiving unit 22, and the second stack plate 40 being disposed below the first stack plate 30 to be upwardly and downwardly movable.

An entrance and exit slit 20*a* for entering and exiting of the paper medium is formed in a top surface of the case 20. The entrance and exit portion 24 may be disposed to be connected to the entrance and exit slit 20*a*. The entrance and exit portion 24 may include two roller members respectively contacting with a top surface and a bottom surface of the paper medium to transport the paper medium.

The first stack plate 30 may be disposed above the paper medium receiving unit 22 and be inclined to guide the paper medium combing from the entrance and exit portion 24 above the second stack plate 40. That is, the first stack plate 30 may be downwardly inclined at a predetermined angle from an end portion adjacent to the entrance and exit portion 24. The end portion 24 of the first stack plate 30 that is situated adjacent to the entrance and exit portion 24, may be connected to the case 20 to be rotatable. Accordingly, the first stack plate 30 may be upwardly rotated based on the end portion that is situated adjacent to the entrance and exit portion 24.

The second stack plate 40 may be disposed to be in parallel below the first stack plate 30, and may be elastically supported towards an upper portion within the paper medium receiving unit 22. Accordingly, the second stack plate 40 may be downwardly moved to be in proportion to a load of paper media. A space between the first stack plate 30 and the second stack plate 40 may increase or decrease depending on an amount of loaded paper media.

Referring to FIG. 4 and FIG. 5, every time loading of the paper medium is completed, the second stack plate 40 may be instantaneously forced to be elevated up to the first stack plate 30. The first stack plate 30 may be upwardly rotated due to interference with the second stack plate 40. Accordingly, the first stack plate 30 and the second stack plate 40 may pressurize paper media loaded between the first stack plate 30 and the second stack plate 40 and thus, a height of the loaded paper media may decrease whereby an amount of paper media to be loaded in the paper medium receiving unit 22 may increase. In the meantime, a forceful elevating instrument may be disposed within the case 20 to adjust a forceful elevation of the second stack plate 40. The forceful elevating instrument may include a plurality of timing belts 41, 42, and 43, a plurality of pulleys 44, 45, and 46, and the like, in order to control an upward/downward movement of the second stack plate 40.

Referring to FIG. 1, FIG. 2, and FIG. 5, the ATM 1 may further include two body couplers 70 and 80 being disposed on one side of the receiving unit 11 of the body to rotate when the body 2 operates, and two cassette couplers 50 and 60 being rotatably mounted to the cassette 10 to thereby be respectively combined with the body couplers 70 and 80 when the cassette 10 is installed. Accordingly, the cassette 10 may receive the power of the body 2 and thereby operate by means of a mechanical combination between the body couplers 70 and 80 and the cassette couplers 50 and 60. Even though the present embodiment is described based on two body couplers and two cassette couplers, a number of body couplers and a number of cassette couplers may vary depending on a configuration of the body 2 and the cassette 10.

The two cassette couplers 50 and 60 may include a first cassette coupler (also referred to as the first cassette coupler 50 to transfer the power from the body 2 to the entrance and exit portion 24, and a second cassette coupler (also, referred to as the second cassette coupler 60) to transfer the power from the body 2 to the forceful elevating instrument. Accordingly, the power transferred from the first coupler 50 may operate the entrance and exit portion 24, and the power transferred from the second cassette coupler 60 may forcefully elevate the second stack plate 40.

The two body couplers 70 and 80 may include a first body coupler (also, referred to as the first body coupler 70) being disposed on one side of each of the receiving units 11 and 13 of the body 2 in order to be combined with the first cassette coupler 50, and a second body coupler (also, referred to as the second body coupler 80) being disposed on another side of each of the receiving units 11 and 13 of the body 2 to be combined with the second cassette coupler 60. The first body coupler 70 and the second body coupler 80 may be connected to a power source such as a motor provided within the body 2 to thereby rotate when the body 2 operates.

Figure 6:
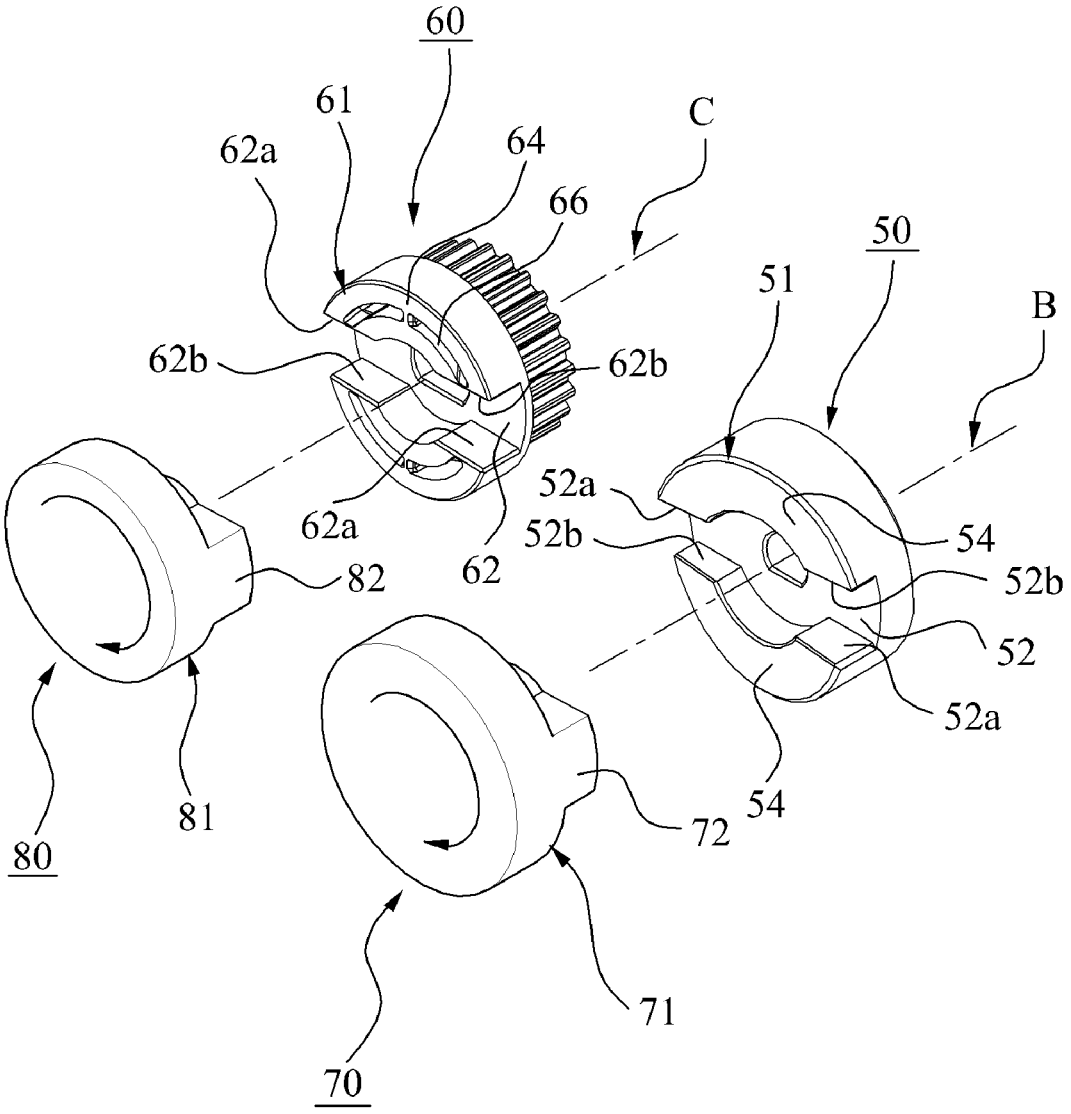
FIG. 6 is an exploded perspective view illustrating a cassette coupler of a cassette and a body coupler of a body according to an embodiment of the present invention.
Figure 7:
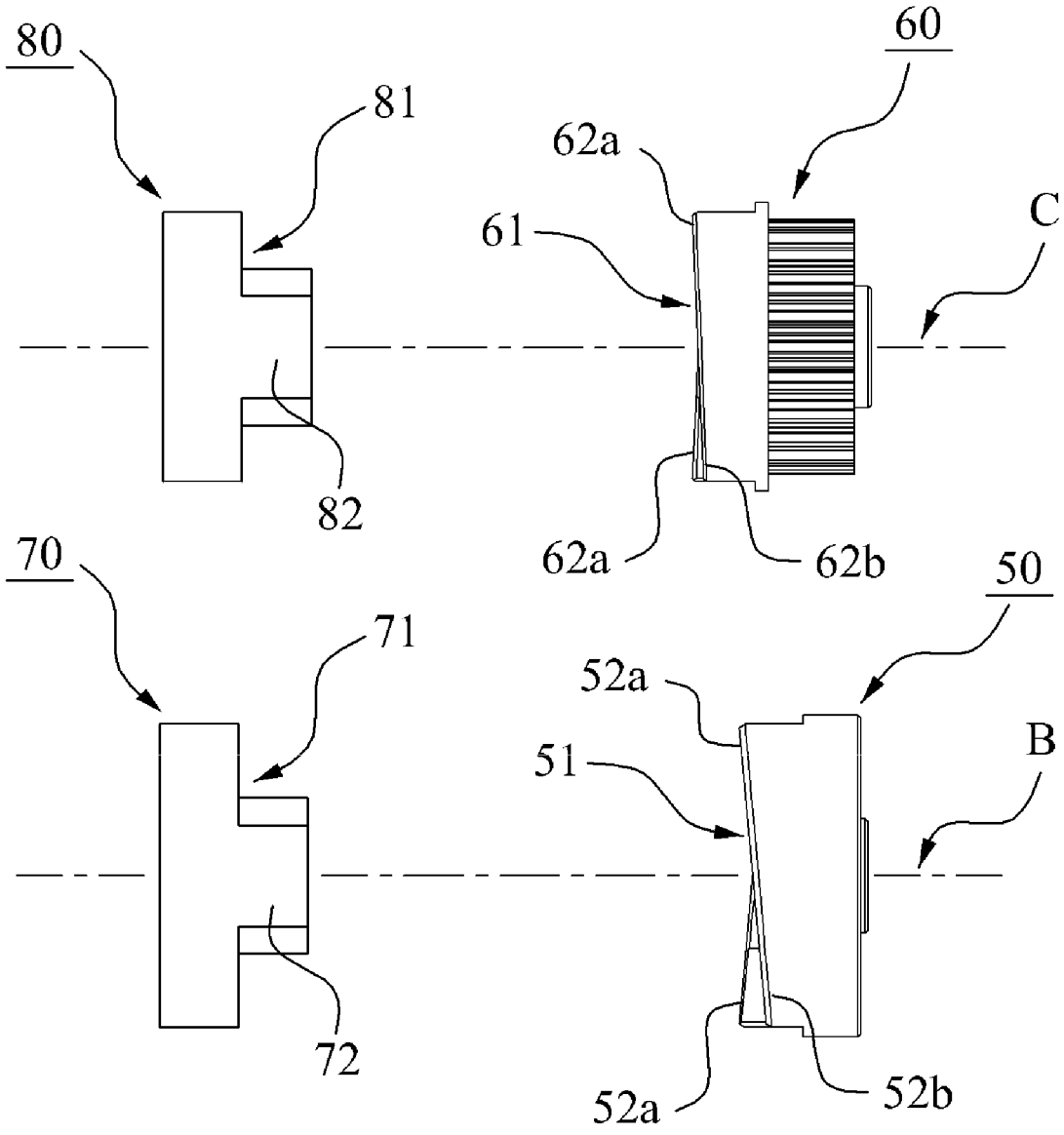
FIG. 7 is a plan view illustrating the cassette coupler and the body coupler of FIG. 6.
Figure 8:
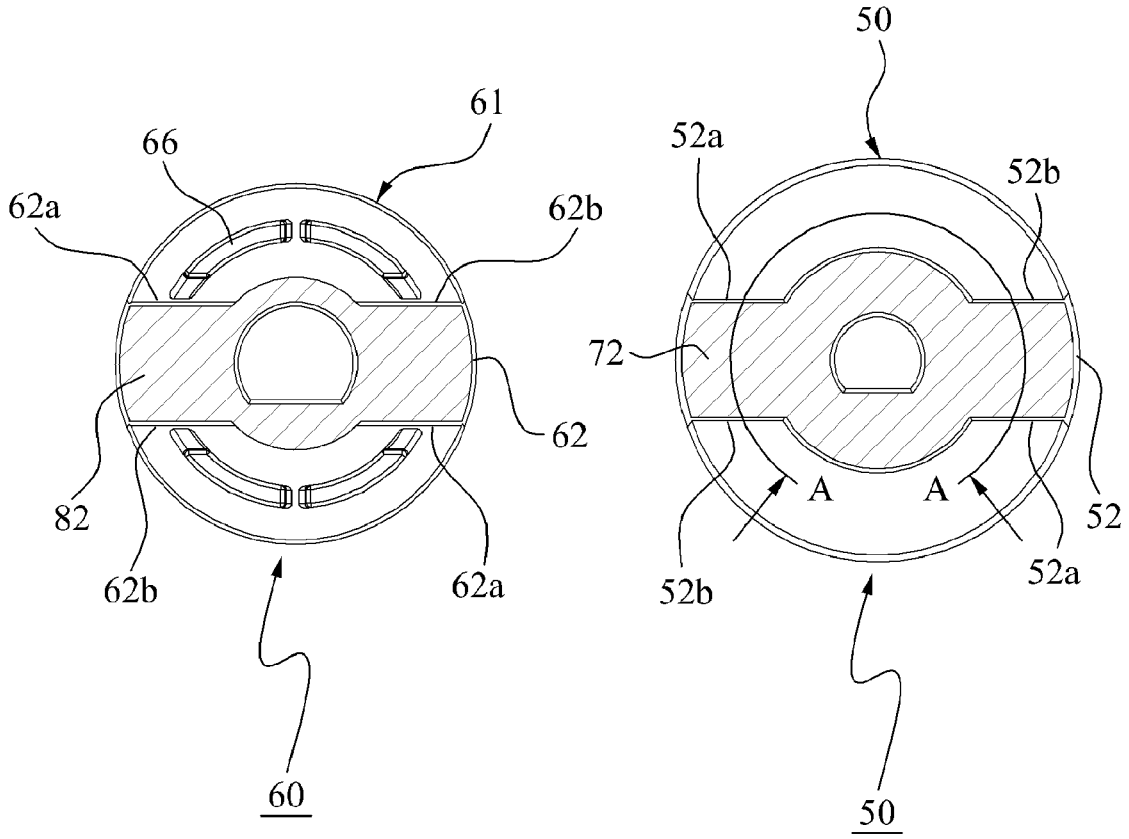
FIG. 8 is a side cross-sectional view illustrating a combination state of the cassette coupler and the body coupler of FIG. 6.
Figure 9:
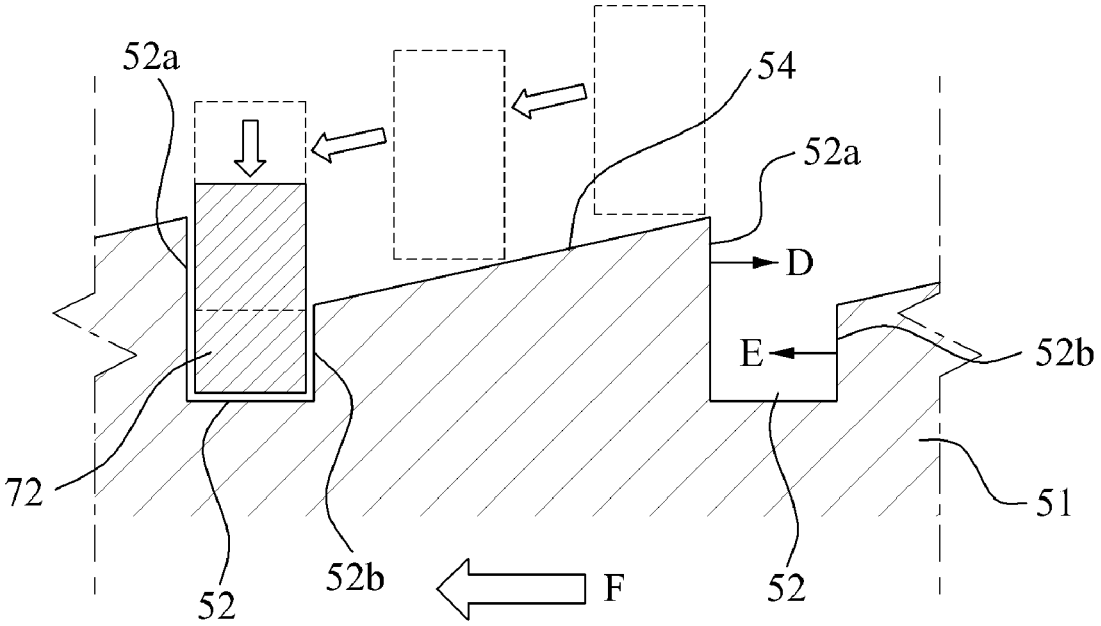
FIG. 9 is a cross-sectional view illustrating a combination process of the cassette coupler and the body coupler according to an A-A line of FIG. 8.

FIG. 6 is an exploded perspective view illustrating the cassette couplers 50 and 60 of the cassette 10 and the body couplers 70 and 80 of the body 2 according to an embodiment of the present invention, FIG. 7 is a plan view illustrating the cassette couplers 50 and 60 and the body couplers 70 and 80 of FIG. 6, FIG. 8 is a side cross-sectional view illustrating a combination state of the cassette couplers 50 and 60 and the body couplers 70 and 80 of FIG. 6, and FIG. 9 is a cross-sectional view illustrating a combination process of the cassette coupler 50 and the body coupler 70 according to an A-A line of FIG. 8.

Referring to FIG. 6 through FIG. 9, the first body coupler 70 and the second body coupler 80, and the first cassette coupler 50 and the second cassette coupler 60 may be respectively combined with each other on the same line in a form to match rotation center lines B and C. Specifically, the first body coupler 70 and the first cassette coupler 50 may be combined with each other into an axial direction and thereby rotate together. The second body coupler 80 and the second cassette coupler 60 may be combined with each other into an axial direction and thereby rotate together.

At least one of the first body coupler 70 and the first cassette coupler 50, and at least one of the second body coupler 80 and the second cassette coupler 60 may be elastically installed in the body 2 or the cassette 10 in order to secure an axial direction binding force. Specifically, the first and second body couplers 70 and 80, and the first and second cassette couplers 50 and 60 may be respectively disposed at interfering positions into the axial direction. When the cassette 10 is installed, at least one of the first and second body couplers 70 and 80, and the first and second cassette couplers 50 and 60 may elastically move towards the axial direction and thereby be combined with each other.

Combination grooving units 52 and 62 may be respectively formed in combining units 51 and 61 of the first cassette coupler 50 and the second cassette coupler 60, into a radius direction from respective corresponding rotation centers passed by the rotation center lines B and C. Combination protrusions 72 and 82 may be respectively protruded from the combining units 71 and 81 of the first body coupler 70 and the second coupler 80 in the same shape as the combination grooving units 52 and 62 to be inserted into the combination grooving units 52 and 62 of the first cassette coupler 50 and the second cassette coupler 60.

In the combining units 51 and 61 of the first cassette coupler 50 and the second cassette coupler 60, the combination grooving units 52 and 62 may be respectively formed at a plurality of positions that are spaced apart at the same angle based on the rotation center lines B and C. Specifically, the combination grooving units 52 and 62 may be respectively formed in the combining units 51 and 61 of the first cassette coupler 50 and the second cassette coupler 60 into a radiation form based on the rotation center lines B and C. For example, when the combination grooving units 52 and 62 are respectively formed on the combining units 51 and 61 at two positions that are spaced apart at 180 degrees based on the rotation center lines B and C into a radius direction, the combination grooving units 52 and 62 may form an overall linear shape.

Also, when the combination grooving units 52 and 62 are respectively formed on the combining units 51 and 61 of the first and second cassette couplers 50 and 60 at four positions that are spaced apart at 90 degrees based on the rotation center lines B and C, the combination grooving units 52 and 62 may form an overall cross shape. Hereinafter, descriptions will be made based on an example that the combination grooving units 52 and 62 are respectively formed in a linear shape on the combining units 51 and 61 of the first and second cassette couplers 50 and 60. Accordingly, the combining protrusions 72 and 82 may be protruded from the combining units 71 and 81 of the first and second body couplers 70 and 80 to be in the same shape as the combination grooving units 52 and 62.

Referring to FIG. 6, FIG. 8, and FIG. 9, in the combination grooving units 52 and 62, second side walls 52*a* and 62*a* having a normal D of a direction opposite to the rotation direction F of the first and second cassette couplers 50 and 60 may be formed to be higher than first side walls 52*b* and 62*b* having a normal E of the same direction as the rotation direction of the first and second cassette couplers 50 and 60. In a case where the second side walls 52*a* and 62*a* are formed to be higher than the first side walls 52*b* and 62*b*, when the first and second body couplers 70 and 80 rotate, the combining protrusions 72 and 82 may pass the first side walls 52*b* and 62*b* and thereby be inserted into the combination grooving units 52 and 62. However, it is impossible to deviate from the combination grooving units 52 and thereby pass the second side walls 52*a* and 62*a*.

Also, in the combinations units 51 and 61 of the first and second cassette couplers 50 and 60, inclination guide units 54 and 64 inclined and protruded may be respectively formed between the first side walls 52*b* and 62*b*, and the second sidewalls 52*a* and 62*a*. The inclination guide units 54 and 64 may be respectively formed between the first side walls 52*b* and 62*b*, and the second sidewalls 52*a* and 62*a* so that a height may linearly decrease with going from the second side walls 52*a* and 62*a* towards the first side walls 52*b* and 62*b* along the rotation direction of the first and second body couplers 70 and 80, and the first and second cassette couplers 50 and 60. Accordingly, when directions of the combining protrusions 72 and 82 do not match directions of the combination grooving units 52 and 62 in combining the first and second cassette couplers 50 and 60 with the first and second body couplers 70 and 80, respectively, the combining protrusions 72 and 82 may be disposed on the inclination guide units 54 and 64. Next, when rotating the first and second body couplers 70 and 80, the combining protrusions 72 and 82 may be moved along the inclination guiding units 72 and 82 and then, be simply inserted into the combination grooving units 52 and 62 via the first side walls 52*b* and 62*b*.

A material saving recess 66 may be formed in each of at least one of the first body coupler 70 and the first cassette coupler 50, and at least one of the second body coupler 80 and the second cassette coupler 60 in order to reduce a material cost. The present embodiment is described that the material saving recess 66 is formed in the inclination guide unit 64 of the second cassette coupler 60.

Hereinafter, an operation of the ATM 1 according to an embodiment of the present invention constructed as above will be described as follows:

When an amount of loaded paper media is insufficient or significantly sufficient in the body 2 of the ATM 1, an operation of the ATM 1 may be suspended. The receiving units 11 and 13 of the body 2 may be opened to exchange the cassettes 10 and 12 and then be closed. In this instance, the first and second cassette couplers 50 and 60 of the cassettes 10 and 12 may be respectively combined with the first and second body couplers 70 and 80 of the receiving units 11 and 13. When the ATM 1 is re-operated, the first and second body couplers 70 and 80 may rotate, and the first and second cassette couplers 50 and 60 combined with the first and second body couplers 70 and 80 may also rotate. Accordingly, since the power of the body 2 may be transferred through the first and second cassette couplers 50 and 60, and the first and second body couplers 70 and 80, the cassettes 10 and 12 may commonly use a power source of the body 2 together with the body 2.

In the meantime, when installing the cassettes 10 and 12, combination directions between the first and second cassette couplers 50 and 60, and the first and second body couplers 70 and 80 may not match. In this case, the combining protrusions 72 and 82 of the first and second body couplers 70 and 80 may not be inserted into the combination grooving units 52 and 62 of the first and second cassette couplers 50 and 60. The first and second cassette couplers 50 and 60, and the first and second body couplers 70 and 80 may be respectively disposed in an uncombined state. That is, the combining protrusions 72 and 82 of the first and second body couplers 70 and 80 may be respectively disposed on the inclination guide units 54 and 64 of the first and second cassette couplers 50 and 60.

Next, when the ATM 1 is re-operated, the first and second body couplers 70 and 80 may not rotate. Accordingly, the combining protrusions 72 and 82 may also move along the inclination guide units 54 and 64 and then be respectively inserted into the combination grooving units 52 and 62 via the first sidewalls 52*b* and 62*b* of the first and second cassette couplers 50 and 60 at a one time. In this instance, as the combining protrusions 72 and 82 move towards the first sidewalls 52*b* and 62*b* along the inclination guide units 54 and 64, the combining protrusions 72 and 82 may be moved by a predetermined distance towards the rotation center lines B and C to head for the first and second cassette couplers 50 and 60. When the combining protrusions 72 and 82 are to deviate from the combination grooving units 52 and 62 due to the inertia without being inserted into the combination grooving units 52 and 62, the combining protrusions 52 and 62 may be stopped by the second side walls 52*a* and 62*a* of the first and second cassette couplers 50 and 60 and thus, may be inserted into the combination grooving units 52 and 62 without deviating from the combination grooves 52 and 62. As described above, even though the ATM 1 operates in a state where the combining protrusions 72 and 82 of the first and second body couplers 70 and 80 are not inserted into the combination grooving units 52 and 62 of the first and second cassette couplers 50 and 60, the combining protrusions 72 and 82, and the combination grooving units 52 and 62 may be simply respectively combined with each other without a power loss within a relatively short period of time.

Referring to a case where a paper medium is deposited in the ATM 1, when the paper medium is deposited into the depositing unit 6, the entrance and exit portion 24 may be driven by the power transferred from the first body coupler 70 via the first cassette coupler 50. Accordingly, the paper medium deposited to the depositing unit 6 may be transferred to the exit and entrance portion 24 of the cassette 10 and then, be transported to an inside of the case 20 by means of the entrance and exist portion 24. The paper medium may be transferred to the first stack plate 30. The paper medium inclinedly downwardly transported along the bottom surface of the first stack plate 30 may be loaded on the top surface of the second stack plate 40.

The paper medium loaded on the second stack plate 40 may be sensed by a sensor (not shown). When a predetermined amount of paper media is loaded, the power may be transferred from the second body coupler 80 via the second cassette coupler 60 according to a control of a control unit and the second stack plate 40 may be downwardly moved. As the second stack plate 40 is downwardly moved, a sufficient space capable of loading the paper media may be secured between the first stack plate 30 and the second stack plate 40.

When the above deposition is completed, the second stack plate 40 may be forced to be upwardly elevated until the second stack plate 40 becomes closely attached to the first stack plate 30. The first stack plate 30 may upwardly rotate to be in a horizontal state and the paper media disposed between the first stack plate 30 and the second stack plate 40 may be pressurized by the first stack plate 30 and the second stack plate 40. Next, the second stack plate 40 may repeat an operation of descending and then forcefully ascending a predetermined number of times. Due to the above ascend-and-descend operation of the second stack plate 40, the paper media may be loaded on the second stack plate 40 in a closely attached state.

Figure 10:
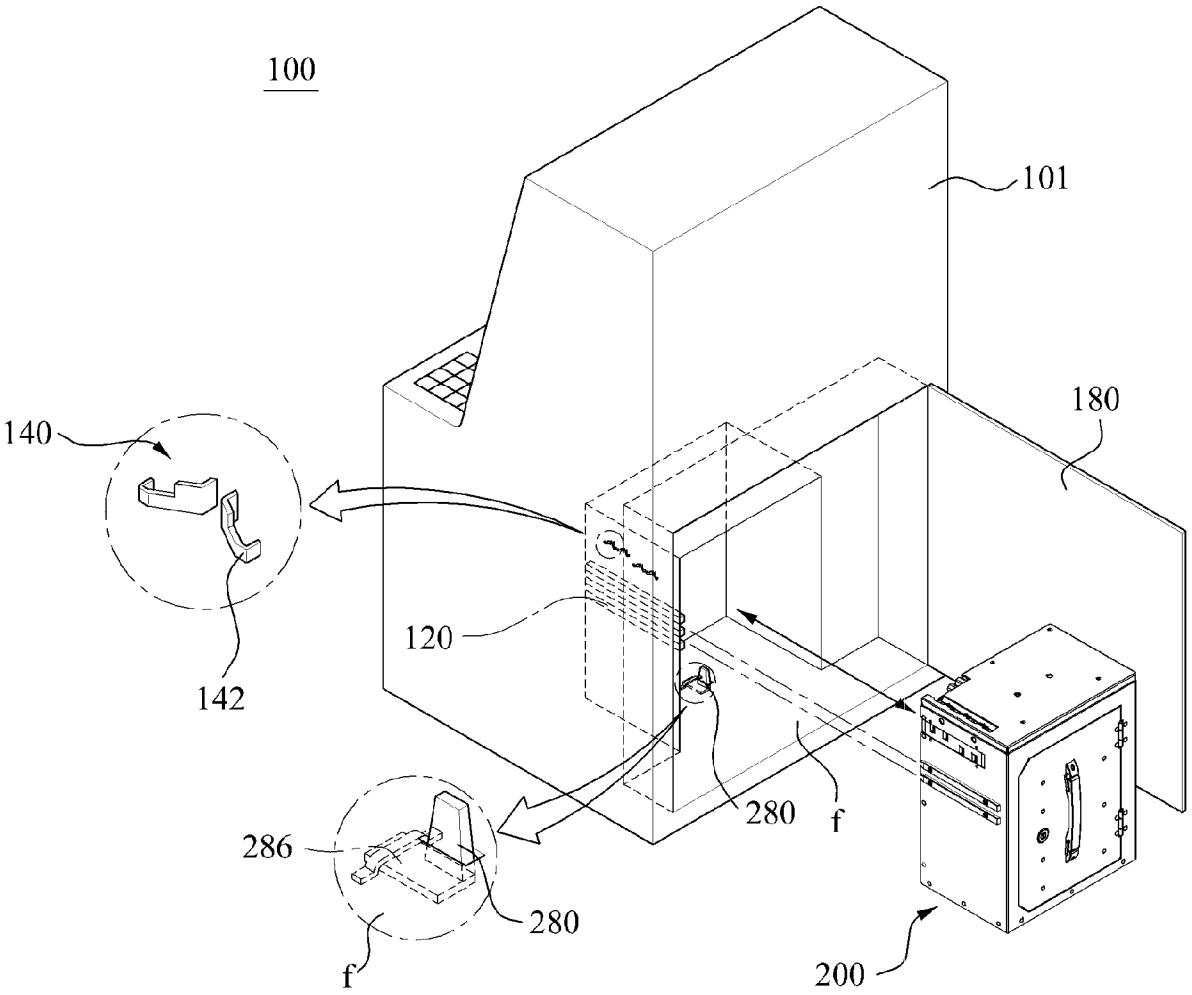
FIG. 10 is a perspective view illustrating an ATM according to another embodiment of the present invention.
Figure 11:
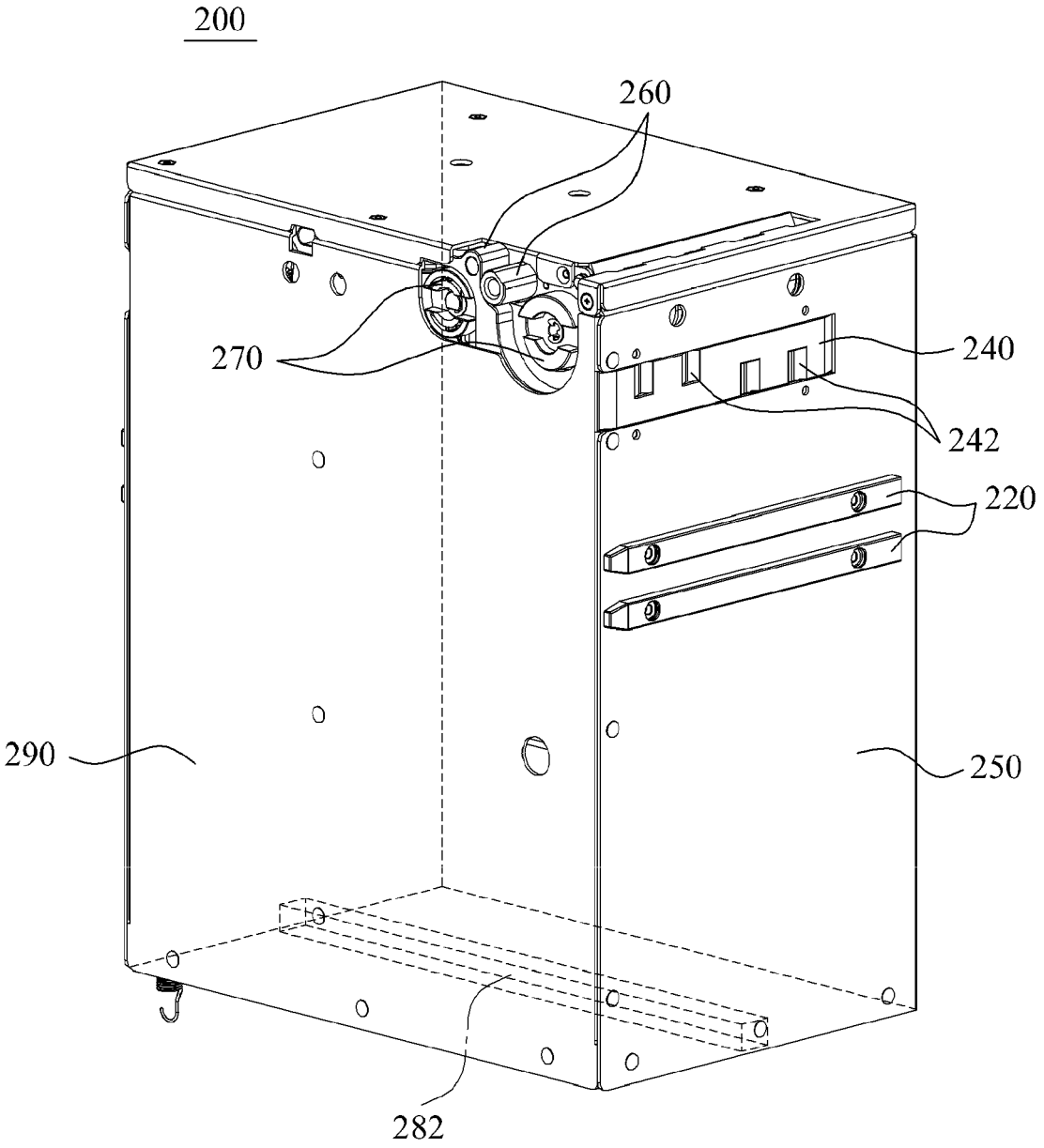
FIG. 11 is a perspective view illustrating a cassette of the ATM of FIG. 10.

FIG. 10 is a perspective view illustrating an ATM 100 according to another embodiment of the present invention, and FIG. 11 is a perspective view illustrating a cassette 200 of the ATM 100 of FIG. 10.

Referring to FIG. 10, the ATM 100 may include a body 101 forming an external appearance and being embedded with various types of machine parts, and at least one cassette 200 being detachable from the body 101 to keep a paper medium such as paper money and the like.

Even though not illustrated here, the ATM 100 may include a display unit being disposed on the body to display transactions for a user, a depositing and withdrawing unit, a pin pad for the user to input a password, and the like. A door 180 may be formed on one side of the body 101 so that the cassette 200 may be kept in the body 101.

A cassette coupler 270 to receive the power from the body 101 may be disposed on the cassette 200 to be received within the body 101. The cassette 200 may include a first guide unit 220, a second guide unit 240, and a third guide unit 260 to facilitate attaching and detaching between the body 101 and the cassette 200, and to enable the cassette 200 to be attached and detached at an exact position.

The first guide unit 220 may be formed on one side of the cassette 200 to be in line with or in parallel with a direction of the cassette 200 being attached to and detached from the body 101. When the cassette 200 is attached to or detached from the body 101, the first guide unit 220 may guide a sliding motion of the cassette 200.

Specifically, when the cassette 200 is received within the body 101, the first guide unit 220 may primarily guide a receiving position of the cassette 200. In other words, when a user desires to determine an initial position of the cassette 200 in order to engage the cassette 200 with the body 101, the first guide unit 220 may facilitate the above operation of the user.

When the cassette 200 slides along the position where the cassette 200 is to be received within the body 101, it is possible to minimize a malfunction of the ATM 100 or the cassette 200. In addition, compared to a case where an operator disposes the cassette 200 within the body 101, it is possible to further facilitate the operation of the operator.

In this instance, a sliding unit 120 corresponding to the first guide unit 220 may be provided within the body 101. The sliding unit 120 may be engaged with the first guide unit 220 to thereby enable the cassette 200 to slide along a position to be attached.

Specifically, the first guide unit 220 may be formed in a guide rail form on one side 250 of the cassette 200 to be in parallel with a sliding direction of the cassette 200. At least one first guide unit 220 may be formed on one side 250 of the cassette 200, and may also be formed on each of both sides of the cassette 200. By forming the first guide unit 220 on each of both sides of the cassette 200, it is possible to balance the force working on left and right of the cassette 200 when attaching and detaching the cassette 200.

Hereinafter, an example where two first guide units 220 are formed in a guide rail form on one side of the cassette 200, a shape of the first guide unit 220 is not limited thereto or restricted thereby.

The second guide unit 240 may be formed on one side 250 of the cassette 200 to be in parallel with the first guide unit 220. When the cassette 200 is received within the body 101, the second guide unit 240 may maintain an engaged state between the cassette 200 and the body 101. Specifically, the first guide unit 220 may determine an initial position of the cassette 200 when the cassette 200 is engaged with the body 101, and guarantee an accurate sliding motion of the cassette 200. The second guide unit 240 functions to maintain a state of the cassette 200 finally mounted to the body 101.

The second guide unit 240 may be formed to have a length shorter than the first guide unit 220. A plurality of receiving grooves 242 formed in parallel with the sliding direction of the cassette 200 or along the sliding direction may be formed on the second guide unit 240. The plurality of receiving grooves 242 including receiving grooves 242*a* and 242*c* may be formed in an area disposed in a diagonal direction among four areas divided by a vertical line and a horizontal line crossing a center of the second guide unit 240. Hereinafter, the receiving groove 242 will be further described with reference to FIG. 14.

In this instance, the body 101 may include an elastic member 140 that may be engaged with the receiving groove 242 of the second guide unit 240. The elastic member 140 may be provided as a pan spring with a curved portion 142.

According to the above configuration, when the cassette 200 is received within the body 101, the curved portion 142 of the elastic member 140 may be engaged with the receiving groove 242 to thereby primarily support and fix the cassette 200 within the body 101.

The cassette 200 may include the third guide 260 being formed on another side 290 of the cassette 200 facing the body 101 to thereby guide the cassette coupler 270 to be exactly engaged with the body 101.

The third guide unit 260 enables the cassette 200 to exactly receive the power from the body 101. Specifically, the cassette coupler 270 may be provided to the cassette 200 in order to receive the power from the body 101. When the body 101 and the cassette coupler 270 are not exactly engaged with each other, the power may not be accurately transferred to the cassette 200. Accordingly, an operator may need to dispose the cassette 200 at an exact position within the body 101. Due to the above reason, the third guide unit 260 enables the cassette 200 and the body 101 to be exactly engaged with each other.

Specifically, a plurality of guide holes 260*a* and 260*b* may be formed in the guide unit 260. A hole insertion means provided to the body 101 may be inserted into each of the guide holes 260*a* and 260*b*. While the hole insertion means is being inserted into each of the guide holes 260*a* and 260*b*, the third guide unit 260 may secondarily guide a mounting position of the cassette 200 within the body 101. The cassette 200 may be secondarily fixed within the body 101.

A fourth guide unit 280 may be provided on a bottom surface of the cassette 200 so that the body 101 and the cassette 200 may be bound with each other. The fourth guide unit 280 may be formed as a hole or a groove so that the cassette 200 may be elastically bound with the body 101 as the cassette 200 is attached to and detached from the body 101, and so that the cassette 200 may be engaged with a blocking protrusion 282 protruded from the bottom surface of the body 101. Even though the fourth guide unit 280 is provided in a hole form in FIG. 11, the shape of the fourth guide unit 280 may be variously modified depending on embodiments. The fourth guide unit 280 and the blocking protrusion 282 will be further described with reference to FIG. 15.

Figure 12:
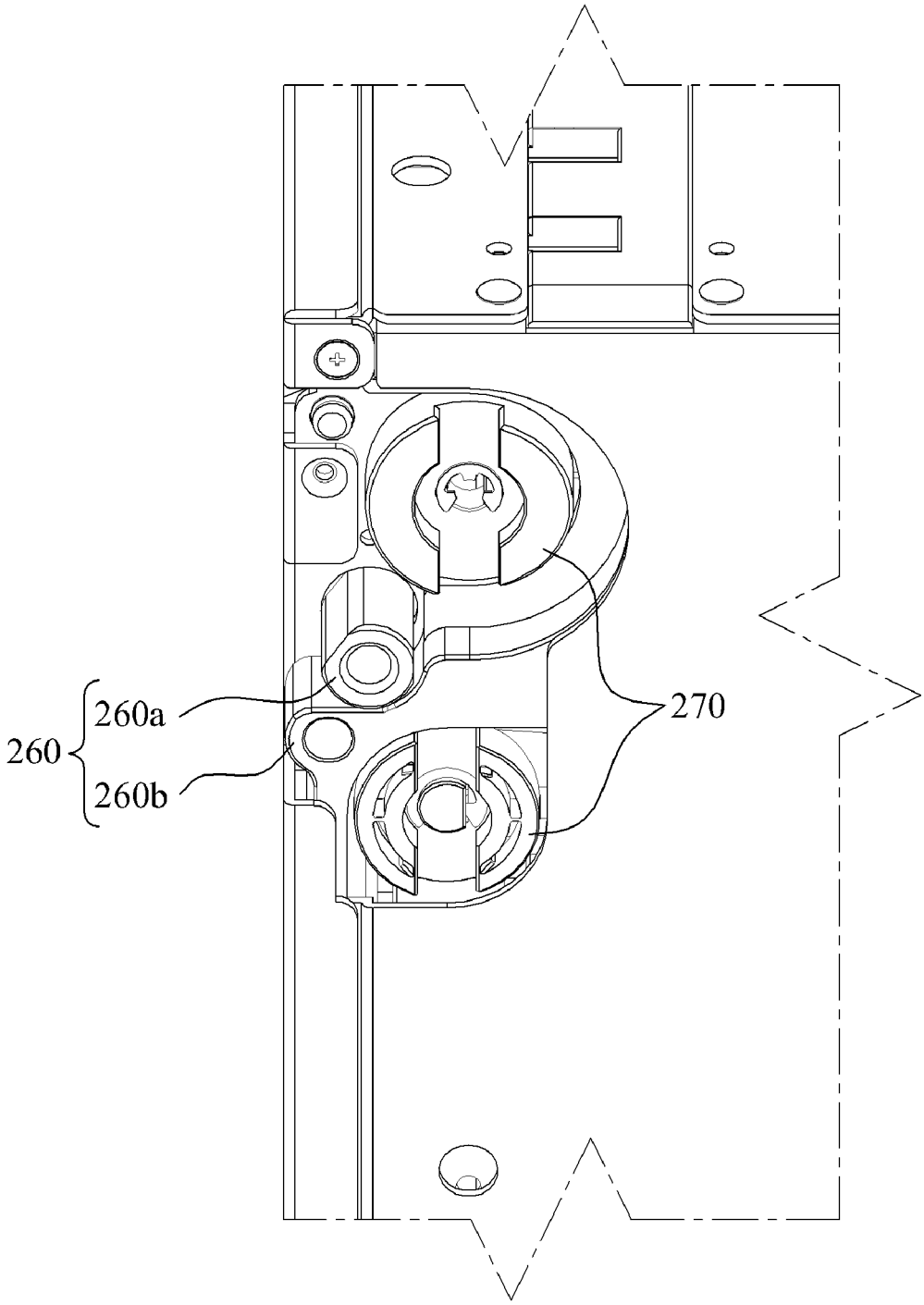
FIG. 12 is a perspective view illustrating a partially enlarged portion of a third guide unit of the cassette of FIG. 11.
Figure 13:
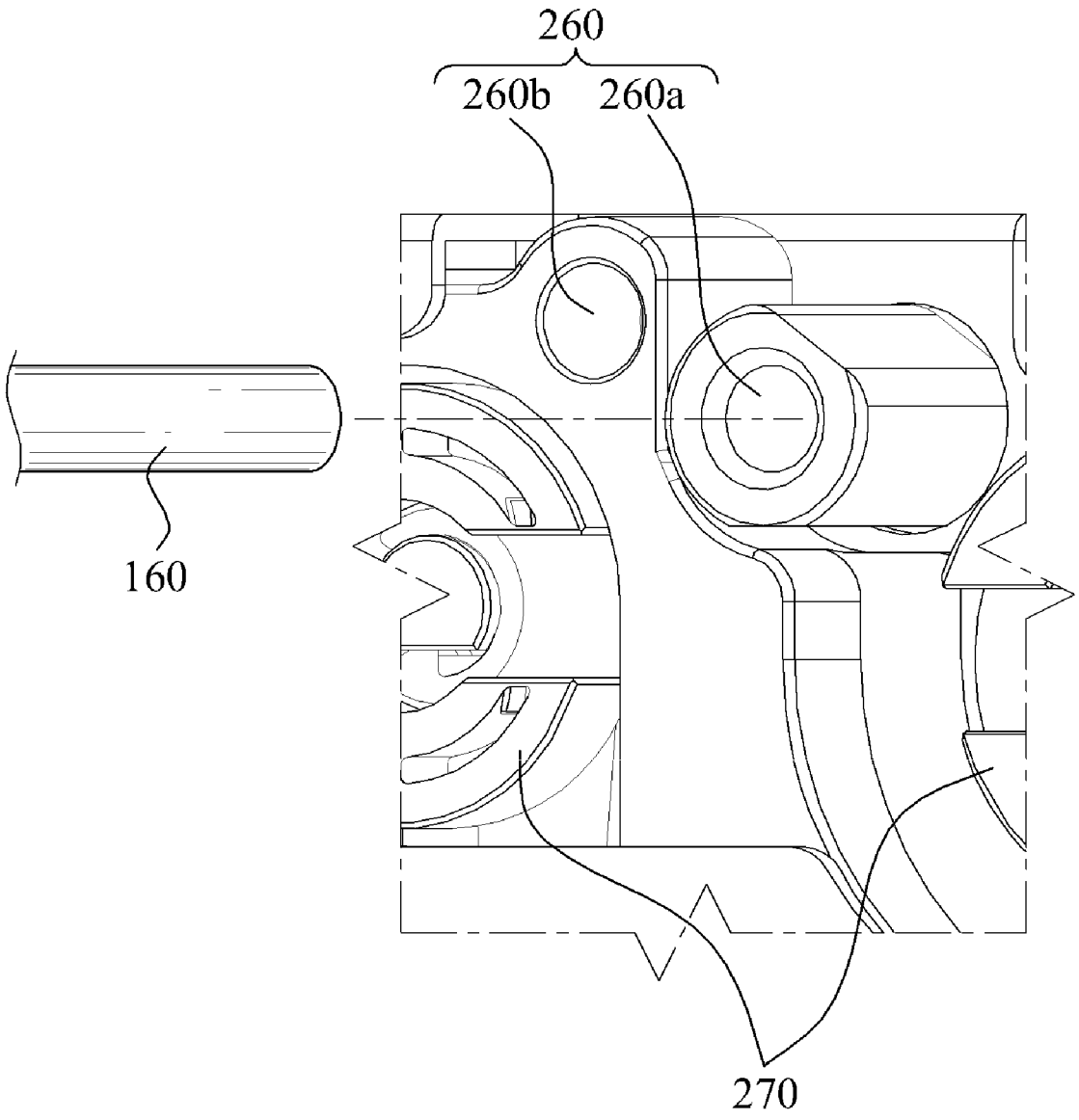
FIG. 13 is a perspective view illustrating a combination relationship between the third guide unit of FIG. 12 and a portion of the body.

FIG. 12 is a perspective view illustrating a partially enlarged portion of the third guide unit 260 of the cassette 200 of FIG. 11, and FIG. 13 is a perspective view illustrating a combination relationship between the third guide unit 260 of FIG. 12 and a portion of the body 101.

Referring to FIG. 12 and FIG. 13, the third guide unit 260 may be provided to be adjacent to the cassette coupler 270. Specifically, as described above, when the cassette 200 is received within the body 101, the third guide unit 260 may be provided to be adjacent to the cassette coupler 270 so that the body 101 and the cassette 200 may be exactly engaged with each other.

A guide pin 160 may be provided as the hole insertion means provided to the body 101, in order to be engaged with the guide holes 260*a* and 260*b*. Referring to FIG. 13, when the cassette 200 is received within the body 101, the guide pin 160 may be inserted into each of the guide holes 260*a* and 260*b* to thereby make an engagement between the body 101 and the cassette 200 firm. Here, the guide pin 160 may be provided in various types of shapes according to a shape of the guide holes 260*a* and 26*b*. The present invention is not limited to the shape, a material, and the like of the guide pin 160 or restricted thereby.

The guide holes 260*a* and 26*b* may be formed in various types of shapes, for example, a circular shape, an elliptical shape, and the like. In general, a diameter, a width, and the like of each of the guide holes 260*a* and 260*b* and the guide pin 160 may be provided to have the same size or shape. Unlikely, the guide holes 260*a* and 260*b* may be formed in the elliptical shape to enable the guide pin 160 to be further easily engaged with each of the guide holes 260*a* and 260*b*. Specifically, since the guide holes 260*a* and 260*b* are formed in the electrical shape or a track shape, the guide pin 160 may be inserted into each of the guide holes 260*a* and 260*b* without great difficulty even though a manufacturing tolerance exists between the guide holes 260*a* and 26*b* and the guide pin 160.

Figure 14:
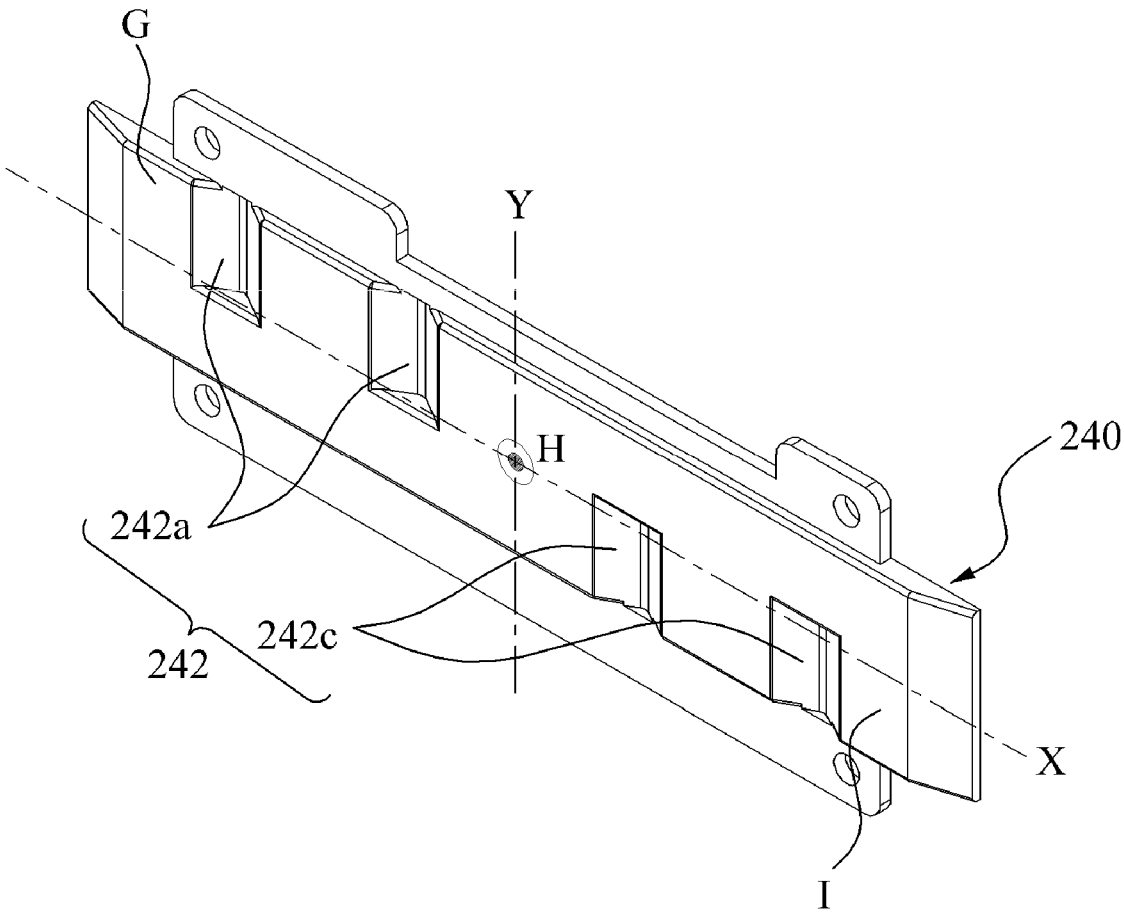
FIG. 14 is a perspective view illustrating a second guide unit of the cassette of FIG. 11.

FIG. 14 is a perspective view illustrating the second guide unit 240 of the cassette 200 of FIG. 11.

Referring to FIG. 14, the second guide unit 240 may be divided into four areas based on a center H of conjugate axes X and Y. The receiving grooves 242 may be formed in an area disposed in a diagonal direction among four areas. As described above, since the receiving grooves 242 and the elastic member 140 of the body 101 are received, it is possible to support and fix an engaged state between the body 101 and the cassette 200.

As shown in FIG. 14, the receiving grooves 242 may be symmetrically formed in up and down or left and right based on the center H of the second guide unit 240. Particularly, the receiving grooves 242 may be formed in four areas of a G area and an I area.

For example, when a direction of the cassette 200 being received within the body 101 is assumed as a G area direction based on the center H of the second guide unit 240, the elastic member 140 of the body 101 may be initially received within the receiving groove 242 formed in the G area. When receiving of the cassette 200 within the body 101 is completed, the elastic member 140 may be mounted to the receiving groove 242 formed in the I area.

Specifically, when the cassette 200 is inserted into the body 101, the elastic member 140 being engaged with the receiving grooves 242*a* that are positioned above the horizontal line X of the second guide unit 240 may contact with the surface of the second guide unit 240 that is disposed on right of the receiving grooves 242*a* before being received in the receiving grooves 242*a*. Accordingly, the cassette 200 may be inserted into the body 101 in a stable state.

In the meantime, when the cassette 200 is separated from the body 101, the elastic member 140 received in the receiving grooves 242*c* that are positioned below the horizontal line X may contact with the surface of the second guide unit 240 that is disposed on left of the receiving grooves 242*c*. Accordingly, the cassette 200 may be separated from the body 101 in a stable state.

As described above, the receiving grooves 242 formed in areas disposed in the diagonal direction among four areas may support and fix the cassette 200 within the body 101.

Specifically, while the elastic member 140 is being received in the receiving grooves 242, left and right of one side 250 of the cassette 200 may be uniformly fixed by the receiving grooves 242 based on the center H of the second guide unit 240. Also, the receiving grooves 242 symmetrically formed above and below based on the center H may be generally engaged with one side 250 of the cassette 200 and thereby enable the cassette 200 to be exactly received within the body 101.

A shape of the receiving grooves 242 may be formed according to a shape of the elastic member 242. The present embodiment is described based on an example where the elastic member 140 is formed as a pan spring and thus, the receiving grooves 242 may be formed in a shape that may be engaged with the pan spring.

The receiving grooves 242 may be formed at opposite positions with respect to the second guide unit 240 disposed on both sides of the cassette 200. Specifically, based on an installation direction of the cassette 200, receiving grooves of a second guide unit disposed on left of the cassette 200 may be formed in an order of a lower side and an upper side. Receiving grooves of a second guide unit disposed on right of the cassette 200 may be formed in an order of an upper side and a lower side.

By the first guide unit 220, the second guide unit 240, and the third guide unit 260 constructed as above, the cassette 200 may be exactly engaged with the body 101, thereby enabling the power to be properly transferred. When the operator disposes the cassette 200 in the body 101, the cassette 200 may be guided to a position that needs to be installed and thus, it is possible to further facilitate receiving of the cassette 200.

Figure 15:
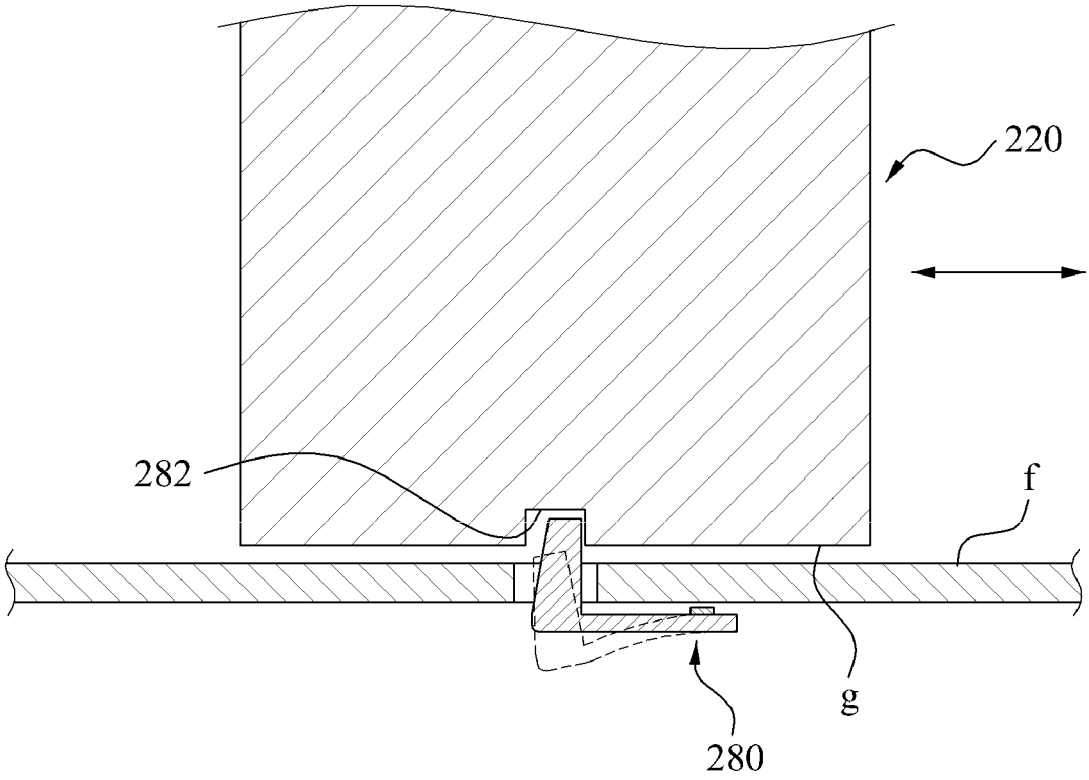
FIG. 15 is a cross-sectional view illustrating an example of installing a fourth guide unit of the cassette of FIG. 11 and a protrusion.

FIG. 15 is a cross-sectional view illustrating an example of installing the fourth guide unit 280 of the cassette 200 of FIG. 11 and the blocking protrusion 282.

Referring to FIG. 15, the blocking protrusion 282 may be formed as a pan spring to be readily transformable when the blocking protrusion 282 is pressurized by a bottom surface g of the cassette 200. When the blocking protrusion 282 is bound with the fourth guide unit 280, the cassette 200 may be tertiarily fixed within the body 101.

In this instance, a releasing unit (not shown) may be further provided to the body 101 to maintain or release a binding state of the cassette 200 from the body 101 and thereby release binding between the fourth guide unit 280 and the blocking protrusion 282. The releasing unit may be formed to release the binding state between the body 101 and the cassette 200 using a predetermined key. Specifically, when the cassette 200 is separated from the body 101, the releasing unit may release the blocking protrusion 282 from the fourth guide unit 280.

Here, the blocking protrusion 282 may be integrally formed with a support board 286 provided below a floor surface f of the body 101 (see FIG. 10). Also, the blocking protrusion 282 may include a fixing unit (not shown) so that the support board 286 may be supported and be fixed on the floor surface f of the body 101. The blocking protrusion 282 may further include an inclination unit (not shown) and a vertical unit (not shown) that are formed towards the installation direction of the cassette 200.

By forming the inclination unit, it is possible to prevent the blocking protrusion 282 from interfering with the bottom surface g of the cassette 200 when installing the cassette 200 to the body 101. By forming the vertical unit, it is possible to maintain a state where the blocking protrusion 282 is hung in the fourth guide unit 280. Here, when the cassette 200 is installed in the body 101, and when the bottom surface g of the cassette 200 pressurizes the inclination unit of the blocking protrusion 282, the support board 286 may be bent whereby the blocking protrusion 282 may smoothly enter the fourth guide unit 280 of the cassette 200.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An automatic teller machine (ATM), comprising:

a body to process depositing or withdrawing of a paper medium;

a cassette being slidably attached to and detached from the body, and comprising a rotatable cassette coupler formed on one side of the cassette to receive a power from the body, and to internally receive the paper medium;

a receiving unit being formed within the body to install the cassette, and comprising a rotatable body coupler being combined with the rotatable cassette coupler when installing the cassette to thereby transfer the power from the body to the cassette; and a combining unit being formed on each of the rotatable body coupler and the rotatable cassette coupler so that a rotation center line of the rotatable body coupler and a rotation center line of the rotatable cassette coupler are matched on the same axial line of the rotatable body coupler and the rotatable cassette coupler to thereby combine the rotatable body coupler and the rotatable cassette coupler, wherein the cassette comprises:

a first guide unit being formed on one side of the cassette along a direction of the cassette attached to and detached from the body to thereby guide a sliding motion of the cassette when the cassette is attached to or detached from the body; and a second guide unit being formed on one side of the cassette to maintain an engaged state when the cassette is mounted to the body, wherein the second guide unit comprises a plurality of receiving grooves being formed along a slide direction of the cassette, and the receiving unit comprises an elastic member to be engaged with the receiving grooves when the cassette is received within the receiving unit, and wherein the receiving grooves are disposed in two diagonal areas out of four areas defined by a vertical line and a horizontal line with respect to a bottom surface of the second guide unit crossing at a center of the second guide unit.

2. The ATM of claim 1, wherein:

a combination groove unit is formed in the combining unit formed in the rotatable cassette coupler, and from a rotation center towards a radius direction, and a combining protrusion in a shape corresponding to the combination groove unit is formed in the combining unit formed in the body coupler to be inserted into the combination grooving unit.

3. The ATM of claim 2, wherein the combination groove unit and the combining protrusion are formed in a radiation form at the same angle based on the rotation center line of the rotatable body coupler and the rotatable cassette coupler.

4. The ATM of claim 2, wherein the combination groove unit comprises a second sidewall having a normal of a direction opposite to a rotation direction of the rotatable cassette coupler and the rotatable body coupler and formed to be higher than a first sidewall having a normal of the same direction as the rotation direction of the rotatable cassette coupler and the rotatable body coupler.

5. The ATM of claim 4, wherein the combining unit formed with the combination groove unit comprises:

an inclination guide unit being formed between the first sidewall and the second sidewall so that a height linearly decreases with going from the second sidewall towards the first sidewall along the rotation direction of the rotatable cassette coupler and the rotatable body coupler.

6. The ATM of claim 1, wherein the cassette further comprises:

a third guide unit being formed with a guide hole being inserted with a guide pin protruded from the receiving unit towards a detachment direction of the cassette to thereby guide the rotatable cassette coupler to exactly be engaged with the body.

7. The ATM of claim 1, wherein the elastic member corresponds to a curved pan spring, and curved portions of the pan spring are positioned in the receiving grooves in a state where the cassette is engaged with the body.

8. The ATM of claim 6, wherein the cassette further comprises:

a fourth guide unit being bound with a blocking protrusion of a pan spring scheme provided on a bottom surface of the receiving unit.

9. The ATM of claim 1, wherein:

the first guide unit and the second guide unit are formed on each of both sides of the cassette, and the receiving grooves are formed to be positioned in opposition positions with respect to the second guide unit disposed on each of both sides of the cassette.

* * * * *